US006446966B1

(12) United States Patent
Crozier

(10) Patent No.: US 6,446,966 B1
(45) Date of Patent: Sep. 10, 2002

(54) CHESS GAME AND METHOD

(76) Inventor: Henri Crozier, 20, boulevard de Boissy, Le Plessis Bouchard, F-95130 (FR)

( * ) Notice: Subject to any disclaimer, the term of this patent is extended or adjusted under 35 U.S.C. 154(b) by 0 days.

(21) Appl. No.: 09/527,001

(22) Filed: Mar. 16, 2000

(51) Int. Cl.[7] ..... A63F 3/00

(52) U.S. Cl. ..... 273/236; 273/238; 273/260; 273/261

(58) Field of Search ..... 273/236, 260, 273/261, 238

(56) References Cited

U.S. PATENT DOCUMENTS

| | | | | | |
|---|---|---|---|---|---|
| 511,306 | A | * | 12/1893 | Moore | 273/261 |
| 801,903 | A | * | 10/1905 | Paxton | 273/137 |
| 1,602,639 | A | * | 10/1926 | Bosco | 273/137 |
| 3,408,073 | A | * | 10/1968 | Suvada | 273/137 |
| 3,532,342 | A | * | 10/1970 | Simpson et al. | 273/131 |
| 3,794,326 | A | * | 2/1974 | Bialek | 273/131 KC |
| 3,829,099 | A | * | 8/1974 | Lucero | 273/131 KC |
| 3,873,101 | A | * | 3/1975 | Kelly | 273/131 K |
| 3,881,731 | A | * | 5/1975 | Droney | 273/137 R |
| 4,015,849 | A | * | 4/1977 | MacLean | 273/131 KC |
| 4,021,043 | A | * | 5/1977 | Lucero | 273/131 AB |
| 4,515,371 | A | | 5/1985 | Basevi | 273/260 |
| 4,856,789 | A | | 8/1989 | Carlson | 273/261 |
| 5,011,159 | A | | 4/1991 | Fortunato et al. | 273/260 |
| 5,160,145 | A | * | 11/1992 | Bokhagen | 273/260 |
| 5,257,787 | A | | 11/1993 | Miccio | 273/260 |
| 5,275,414 | A | | 1/1994 | Stephens et al. | 273/261 |
| 5,312,110 | A | * | 5/1994 | Youwanes | 273/260 |
| 5,421,582 | A | * | 6/1995 | Ritter | 273/261 |
| 5,449,178 | A | | 9/1995 | Castronova | 273/260 |
| 5,735,523 | A | * | 4/1998 | Fioriglio | 273/261 |
| 5,791,992 | A | | 8/1998 | Crump et al. | 463/41 |
| 5,901,957 | A | * | 5/1999 | Leyva et al. | 273/261 |
| 6,000,698 | A | * | 12/1999 | Woodward | 273/260 |
| 6,095,523 | A | * | 8/2000 | Lampman | 273/260 |

FOREIGN PATENT DOCUMENTS

| | | | | |
|---|---|---|---|---|
| FR | 2 592 809 A1 | * | 1/1986 | A63F/3/00 |
| GB | 2 180 765 A | * | 4/1987 | A63F/3/02 |

OTHER PUBLICATIONS

"The F.I.D.E. Laws of Chess," author unknown, republished on the Internet at URL www.chessvariants.com/fidelaws.html on or about Feb. 11, 1998 at pp. 1–17.

* cited by examiner

*Primary Examiner*—Benjamin H. Layno
*Assistant Examiner*—D Collins
(74) *Attorney, Agent, or Firm*—Sonnenschein Nath & Rosenthal; Brian R. McGinley, Esq.

(57) ABSTRACT

A chess game and method for opposed players includes a six-by-eight checkerboard-style game board, two sets of game pieces, each set including conventional chess pieces, e.g. a King, a Queen, a Bishop, a Rook, a Knight, and six Pawns, and a novel chess piece named the Lord. The Lord may be moved about the game board one square in any direction from its current square. A method is also disclosed wherein the chess game is played for a fixed duration of time, and points are awarded to the players based upon the number of game pieces remaining on the game board at the expiration of the allotted time. The player having the highest cumulative point total at the end of the game is then declared the winner. A method is also disclosed for adapting the chess game for play electronically, such as through a global network of computers.

21 Claims, 6 Drawing Sheets

CHESS GAME AND METHOD

BACKGROUND OF THE INVENTION

A. Field of the Invention

This invention relates generally to board games, and more particularly to an improved version of conventional chess.

B. Prior Art

The game of chess is well-known, dating back hundreds or even thousands of years by most accounts. Conventional chess is a two-player game played on a chessboard having sixty-four alternating black and white squares comprising eight horizontal rows, and eight vertical columns. In conventional chess, each player begins the game with sixteen movable game pieces as follows: one King, one Queen, two Rooks, two Bishops, two knights and eight Pawns. The object of conventional chess is to "checkmate" the opposing player's King. Each player's pieces are initially positioned in a predetermined opposed, mirrored relation to his or her opponent's pieces. The players alternate turns, which consist of moving one of the player's pieces to a different square on the chess board. A player captures his or her opponent's pieces during a turn by moving his or her piece into a square occupied by one of the opponent's pieces.

By rule, each game piece in classic chess has limitations placed upon its movement. For example, the King generally may move one square in any available direction (e.g. horizontally, vertically, or diagonally). The Queen may move through any number of unobstructed squares in any straight line (e.g. horizontally, vertically or diagonally). The Queen may not jump other pieces. The Rook may move through any number of unobstructed squares in a straight line, either horizontally or vertically. The Rook may not jump other pieces. The Bishop may move through any number of unobstructed squares in any straight diagonal line. The Bishop may not jump other pieces. The Knight makes a move which consists of a first one-square step in either a horizontal or a vertical direction, and a second one-square step diagonally. The Knight may jump other pieces. With the following two exceptions, the Pawn may only move forward one square. First, on its initial move, the Pawn may move forward one or two squares. Second, the Pawn captures other pieces by moving one square diagonally.

It should be noted that, in conventional chess, other variant moves are permitted under limited circumstances, such as "castling" moves and "en passant" capture moves. Castling involves the simultaneous movement of the King and the Rook. Several castling moves are known. For example, in one castling move the King moves horizontally along a row two squares inward toward the Rook, and the Rook moves horizontally over and beyond the King to the next adjacent square in that row.

An "en passant" capture is a move executed by the Pawn in which the Pawn attacks an opposing Pawn, the opposing Pawn having just been advanced two squares from its original square in one move. In such circumstances, the attacking Pawn may move diagonally one square into the square passed over by the opposing Pawn and capture the Pawn.

In addition to classical chess, many alternative versions of chess have developed through the years. For example, U.S. Pat. Nos. 5,449,178, 5,421,582, 5,275,414, 5,257,787, 5,011,159, 4,856,789, and U.S. Pat. No. 4,778,187 disclose exemplary variations on conventional chess.

Although conventional chess and some of its variations have achieved notoriety and respect from fans and players alike, a need exists for a new and improved chess variation to provide new challenges to conventional capture strategies. Further, due to the large size of the conventional chess game board and the high number of pieces used, and due to the complex rules and strategy which are employed by chess players attempting to checkmate the opposing player's King, it often takes several hours or longer to complete a game of conventional chess. A need exists for an improved, simplified chess game which can be played in a short period of time.

SUMMARY OF THE INVENTION

The present invention presents a chess game and method for playing the same. The game is played by opposed players or groups of players on a six-by-eight checkerboard-style game board. Each player begins the game with a total of twelve playing pieces: a King, a Queen, a Lord, a Bishop, a Rook, a Knight and six Pawns. As with conventional chess, the players alternatively move their pieces. However, the time allotted for any given move is limited by rule. Further, the overall game length is also limited.

The King, the Queen, the Bishop, the Rook, the Knight and the Pawn move as in conventional chess. However, the Lord is a novel piece. The Lord moves in a fashion similar to the King in conventional chess, but is not constrained by many of the restrictions associated with the King. For example, the Lord cannot be placed in "checkmate", and the game does not end if the Lord is captured.

The Lord may move one square diagonally, horizontally or vertically from its original square. The Lord begins the game immediately adjacent the King. The Lord's mobility lends itself well to protecting the King. Thus, the addition of the Lord forces players to develop new capture strategies, and changes the overall complexion of the game as compared to conventional chess.

Each game piece has an associated point value so long as it remains "in play" during the game. The points are assigned to the game pieces on a sliding scale. For example, each Queen which remains "in play" is worth nine points, each Lord is worth seven points, each Rook is worth five points, etc.

The game may be terminated, among other ways, by a player placing the opposing player's King in "checkmate", or, alternatively, by the expiration of the allotted time. In the latter case, the player with the highest cumulative point total remaining on the board is declared the winner.

Accordingly, the present invention provides a novel chess game, including the introduction of a new major piece: the Lord. Another advantage of the present invention is the use of a "scoring system" as an alternative basis to declare a winner. Another advantage of the present invention is its simple rules which are easy to understand.

Other advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various features thereof.

DESCRIPTION OF THE PREFERRED EMBODIMENTS

Figure 1:
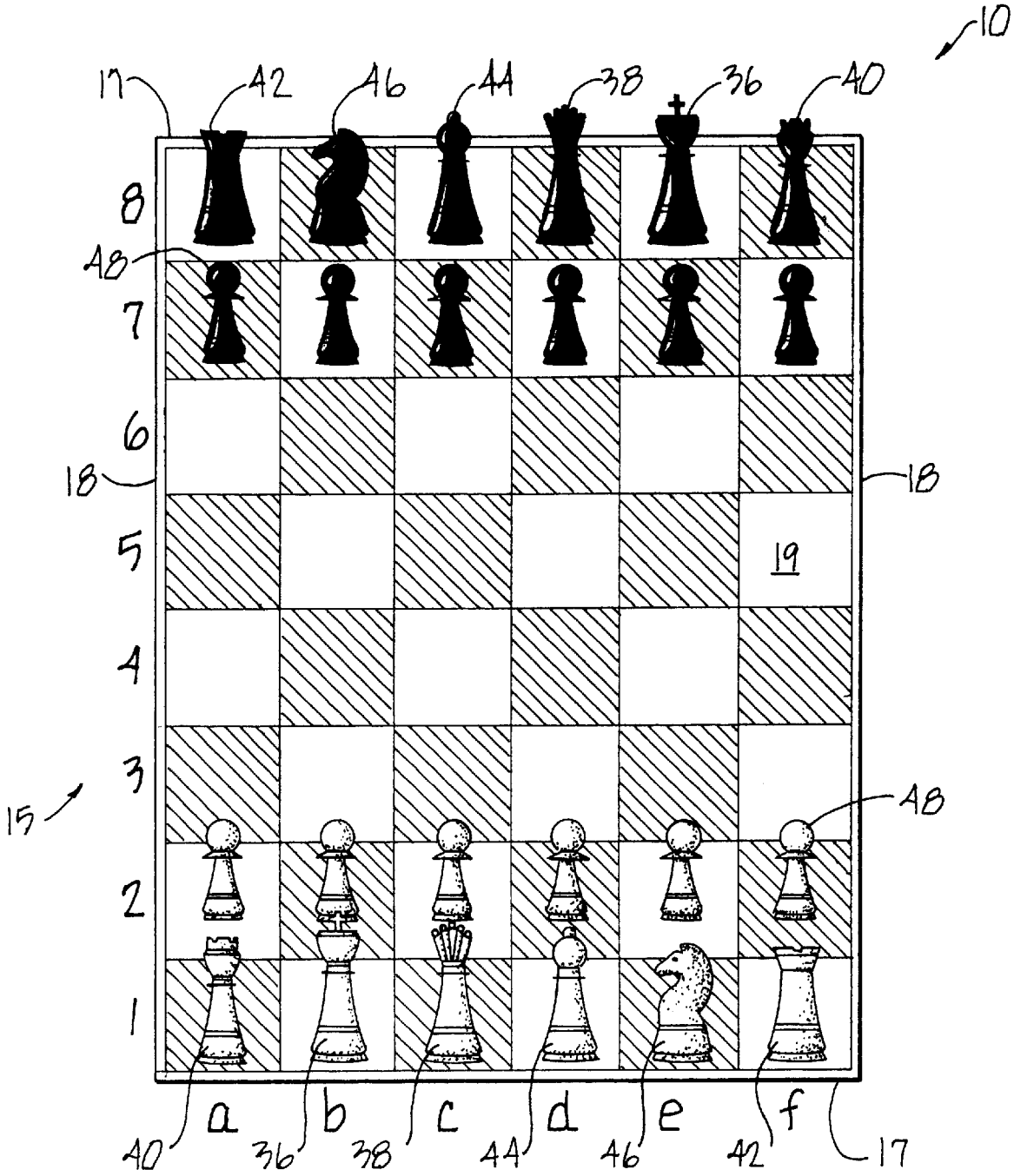
FIG. 1 is a schematic diagram of a chess game embodying the present invention and showing a chess game board and the initial positioning of the chess pieces thereon.

Referring to the drawings and FIG. 1 in greater detail, the reference numeral 10 generally refers to a novel chess game embodying the present invention. The game 10 incorporates the basic rules of conventional chess as modified herein. Preferably, the game 10 is played on a game board 15 having opposed ends 17 and opposed sides 18. The game board 15 comprises a grid of forty-eight alternating black and white colored squares 19 which form a checkerboard pattern.

The game board 15 has eight horizontal rows or "ranks," and six vertical columns or "files." Each rank is defined as the adjacent horizontal squares which extend between the sides 18. Referring to FIG. 1, each rank is identified numerically (e.g. 1–8, respectively). Each file is defined as adjacent vertical squares 19 which extend between the ends 17. Referring to FIG. 1, each file is identified alphabetically (e.g. a–f, respectively).

The game 10 is designed for two players or groups of players, one player being assigned a set of light or white game pieces, and the other player being assigned a set of dark or black game pieces. Each player begins the game 10 with twelve game pieces as follows: a King 36, a Queen 38, a Lord 40, a Rook 42, a Bishop 44, a Knight 46 and six Pawns 48.

The physical appearance of the King 36, the Queen 38, the Rook 42, the Bishop 44, the Knight 46 and the Pawn 48 is substantially the same as that of equivalent pieces in conventional chess.

Figure 3:
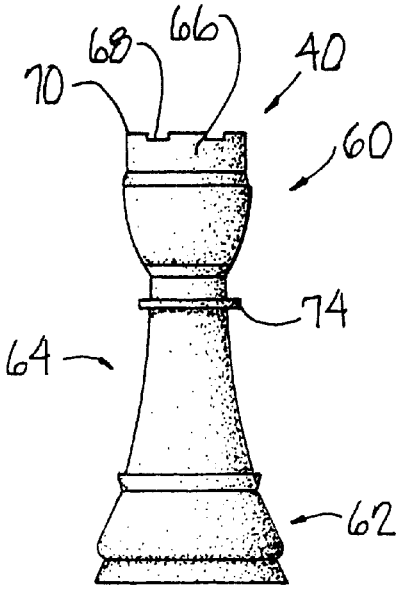
FIG. 3 is a front elevational view of a novel Lord chess piece of the present invention.
Figure 3A:
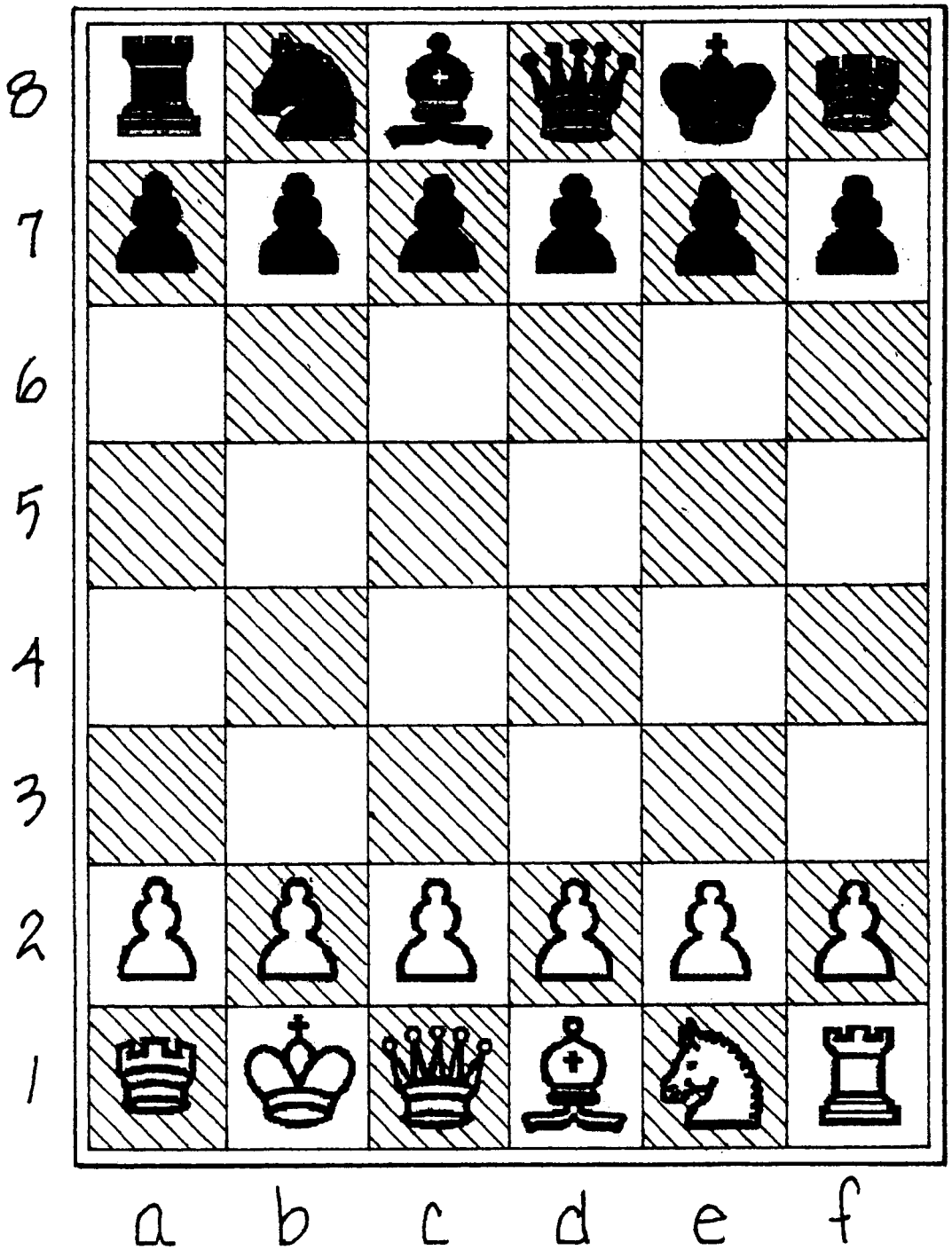
FIG. 3*a* is a schematic drawing of the chess game board illustrating the rank and file of individual game board squares.

The Lord 40 is novel in both function (as discussed below) and appearance. The Lord 40 is made in a similar manner and constructed of the same types of materials as conventional chess pieces. Referring to FIG. 3, the Lord 40 includes an upper section 60, a supportive base 62, and an elongated mid section 64. The upper section 60 includes a crown 66 having a plurality of notches 68 radially-spaced along an upper crown edge 70. The mid section 64 tapers inward from a lower portion to an upper portion thereof. An annular rim 74 extends from an outer surface of the mid section 64.

Figure 2:
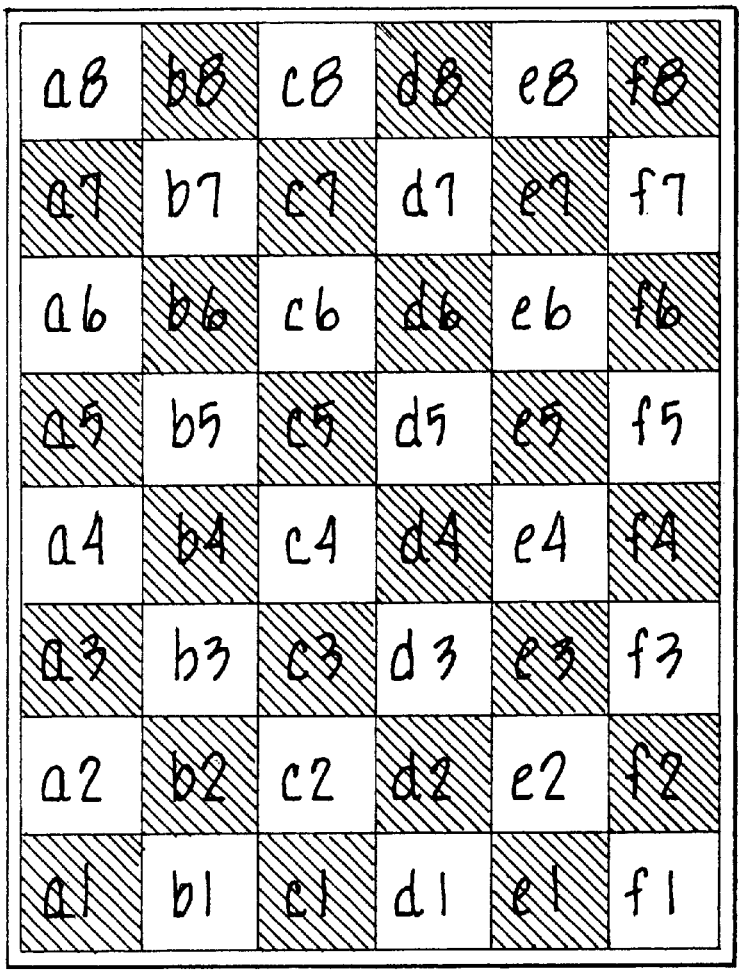
FIG. 2 is a schematic diagram of the chess game board illustrating the rank and file of individual game board squares.

Referring to FIG. 1 and FIG. 2, the game pieces are initially positioned on the game board 15 as follows: the black King 36 is positioned on the square having file e, rank 8 (e.g. e8); the black Queen 38 is positioned on d8; the black Lord 40 is positioned on f8; the black Rook 42 is positioned on a8; the black Bishop 44 is positioned on c8; the black Knight 46 is positioned on b8; the black Pawns 48 are positioned on a7–f7, respectively; the white King 36 is positioned on b1; the white Queen 38 is positioned on c1; the white Lord 40 is positioned on a1; the white Rook 42 is positioned on f1; the white Bishop 44 is positioned on d1; the white Knight 46 is positioned on e1; the white Pawns 38 are positioned on a2–f2, respectively.

The game 10 commences with the white player taking a turn which consists of moving one of his or her pieces. The players then alternate moves or turns. Each player must take his or her turn within 15 seconds after the opposing player's previous turn, or that player loses the game 10 by default. As discussed more below, the overall length of the game 10 is also limited by rule. The objects of the game 10 are to checkmate the opposing player's King 36 within the allotted time, or, alternatively, and as discussed more below, to finish the game with the highest cumulative point total of game pieces remaining in play.

Referring to FIGS. 4*a*–4*g*, the movements of the game pieces during the course of the game 10 is as follows. The King 36 moves as in conventional chess. That is, the King 36 can move one square to any adjoining square 19 (e.g. horizontally, vertically, or diagonally) which is not occupied by a like-colored game piece. The King 36 must move such that it is not in check after the move. As in conventional chess, the King 36 may make a castling move, but only once during the game 10.

The Queen 38 moves as in conventional chess. That is, the Queen 38 can move any number of unobstructed squares in a straight line vertically, horizontally or diagonally. The Queen 38 cannot jump over other pieces.

Figure 4A:
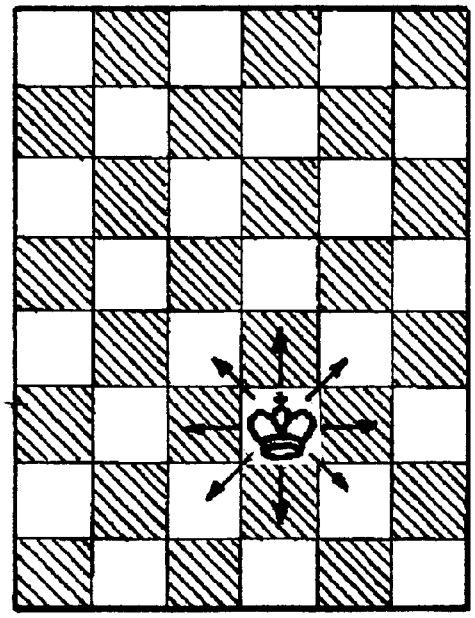
FIG. 4*a* is a schematic diagram showing exemplary moves available for the King.
Figure 4B:
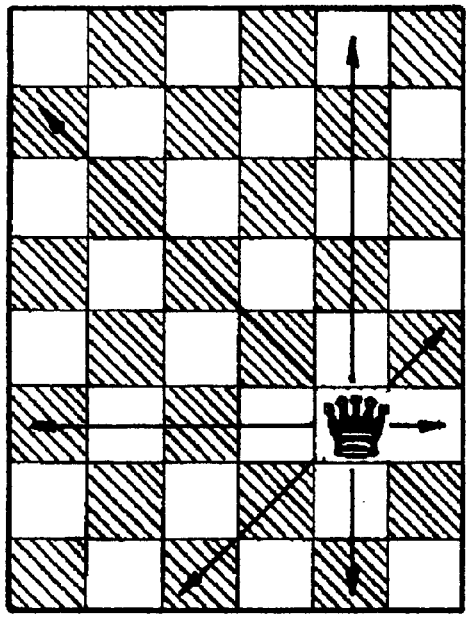
FIG. 4*b* is a schematic diagram showing exemplary moves available to the Queen.
Figure 4C:
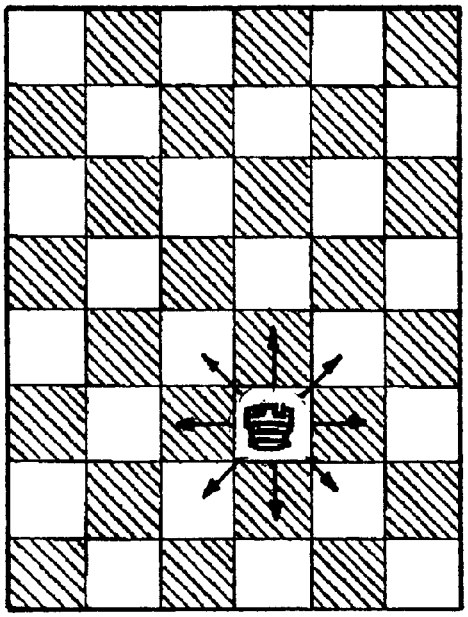
FIG. 4*c* is a schematic diagram showing exemplary moves available for the Lord.
Figure 4D:
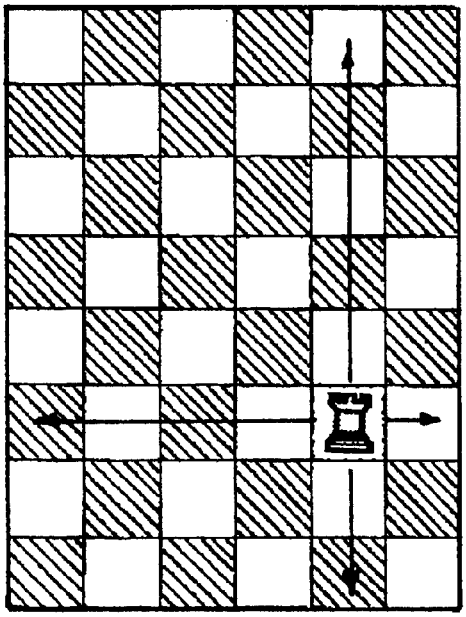
FIG. 4*d* is a schematic diagram showing exemplary moves available for the Rook.
Figure 4E:
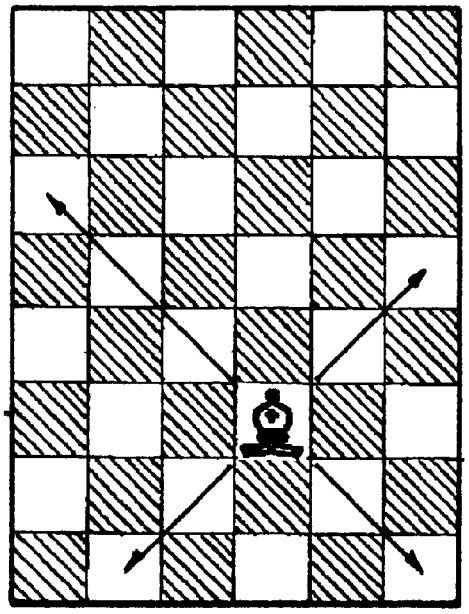
FIG. 4*e* is a schematic diagram showing exemplary moves available for the Bishop.
Figure 4F:
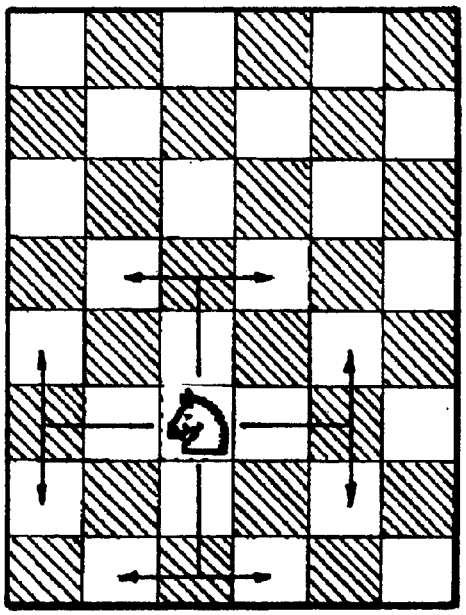
FIG. 4*f* is a schematic diagram showing exemplary moves available for the Knight.
Figure 4G:
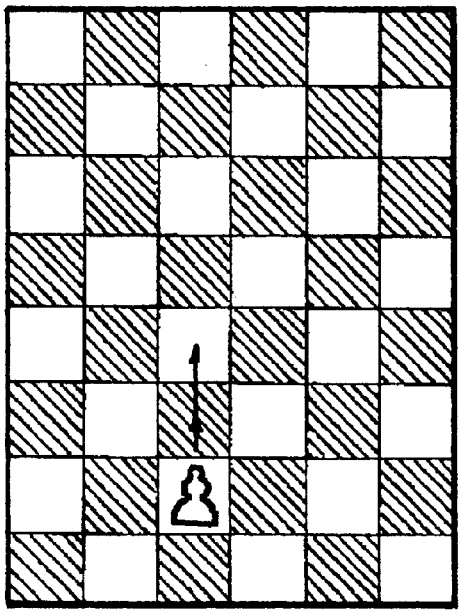
FIG. 4*g* is a schematic diagram showing exemplary moves available for the Pawn.

Referring to FIG. 4*c* the Lord 40 can move from its original square 19 to any adjoining square which is not occupied by a like-colored piece. The Lord 40 may not make a castling move. The Lord's ability to move makes it the second most powerful game piece, next to the Queen 38. A player may use his or her Lord 40 to protect the King 36 from attack, making it much harder for the opposing player to achieve checkmate of the King 36.

Although the Lord 40 moves in a similar fashion to the King, the Lord 40 does not have many of the restrictions which constrain the King 36. For example, the Lord 40 is never placed in "checkmate" by an opponent, and as such need not move out of check. Also, the game 10 does not end when the Lord 40 is captured.

The Rook 42 moves as in conventional chess. That is, the Rook 42 can move any number of unobstructed squares in a straight line, vertically or horizontally. The Rook 42 cannot jump over other pieces.

As with conventional chess, the Knight 46 moves from its current square 19 two squares in a straight line either horizontally or vertically, and then moves one additional square at a right angle thereto. The Knight 46 can jump other pieces.

The Pawn 48 moves as in conventional chess. Thus, with the exception of a capturing move, the Pawn 48 can only move forward. On its first move each Pawn 48 can move from its current square 19 forward one or two squares. Otherwise, the Pawn 48 can move forward one square from its current square. The Pawn 48 may capture en passant.

However, the en passant capture can only be made by each Pawn 48 on its first move. Each player must capture en passant, if at all, on the next move immediately after the opposing player's Pawn 48 is moved into a position to be captured en passant.

As with conventional chess, each player's Pawns 48 are promoted upon reaching the rank adjacent the opposing end 17 of the game board 15. Each Pawn 48 can be promoted to any game piece of the player's choice. Thus, it is theoretically possible, for example, for a player to have seven Queens 38 or seven Lords 40 in the game 10 at the same time.

As shown in FIG. 1, at the start of the game 10 the Lord 40 is positioned immediately adjacent the King 36. During the game 10, a player may use his or her Lord 40 to protect the King 36 from "checkmate" by the opposing player's pieces.

In conventional chess, the King is flanked on one side by the Queen and on the other side by the Bishop. The Queen provides the greatest protection to the King because of its ability to move through unoccupied squares in any direction. The Bishop provides moderate protection, but, as the Bishop is only capable of movement along diagonals, the King is left vulnerable to attack.

In the present game, the protection afforded the King 36 is substantially enhanced due to the presence of the Lord 40. During the course of the game 10, a player will most likely keep his or her Lord 40 very close to the King 36 for protection. The Lord's ability to move in any direction and block attacks makes it much more difficult for an opposing player to achieve checkmate. Further, both the Queen 38 and the Lord 40 can protect the square in front of the King 36 from their respective original starting positions. In conventional chess, the focal point of attack is the King. While the King 36 of the present invention remains the focal point, the plan of attack will be substantially altered due to the presence of the Lord 40.

A scoring system is utilized in connection with the game 10 in the event that neither player's King 36 is checkmated within the allotted time. The chess pieces are assigned point values on a sliding scale. Each Queen 38 which remains in play at the expiration of the allotted time is worth nine points. Similarly, each Lord 40 is worth seven points. Each Rook 42 is worth five points. Each Bishop 44 is worth three points. Each Knight 46 is worth three points. Each Pawn 48 is worth one point.

Each game 10 terminates with one winning player, or, alternatively, by "draw" in which case neither player wins. More specifically, the game 10 terminates at the sooner of one of four events: (a) a player captures an opposing player's King 36 (e.g. "checkmate"); (b) the expiration of a predetermined amount of time; (c) a "draw" is declared; or (d) a player resigns or defaults.

The game 10 is won by the player who checkmates his or her opponent's King 36 within the allotted time. As indicated, the game 10 may also terminate at the expiration of a predetermined amount of time (e.g. five minutes, ten minutes, fifteen minutes, thirty minutes, etc.). The length of the game may be varied depending upon the skill level of the players, or simply depending upon the time the players desire to play. If such a period of time expires, and the game 10 has not otherwise terminated, the game 10 is declared immediately terminated. The player with the highest total points, as determined by the cumulative point total value of pieces remaining at termination, is declared the winner. If the players have identical point totals, a draw is declared.

Running point totals can also be kept during a series of games 10. For example, the first player to obtain two hundred points after a series of games may be declared the winner.

It is also foreseen that the scoring system may be used in connection with a game that is terminated by one player checkmating the opposing player's King 36. For example, in addition to receiving point values for the game pieces remaining "in play" at the game's termination (e.g. checkmate), as discussed above, the player who "checkmates" the opposing player's King 36 may be awarded an additional fifty points.

A draw automatically occurs when a player, having his or her King 36 not in check, is unable to make a legal move. A draw also occurs when all players agree to declare a draw. A draw also occurs automatically by rule when twenty-five consecutive moves have been made by each player or group of players, with neither player capturing any of the opposing player's playing pieces, and neither player's Pawns 48 being moved.

A draw also automatically occurs by rule when the game 10 continues until one of the following three groups of opposing game pieces exclusively remain: (a) the King 36 versus the opposing King 36; or (b) the King 36 versus the opposing King 36 and the opposing Knight 46 or the opposing Bishop 44; or (c) the King 36 and the Bishop 44 versus the opposing King 36 and the opposing Bishop 44; (d) the King 36 and Lord 40 versus the opposing King 36 and the opposing Lord 40.

The game 10 may be adapted for play electronically, for example through the use of computer software and hardware including play between opposing players or multiple groups of players via the Internet. FIG. S illustrates a high-level block diagram of a computer system which is used, in one embodiment, to implement the method of the present invention. The computer system 110 of FIG. 5 includes a processor 112 and memory 114. Processor 112 may contain a single microprocessor, or may contain a plurality of microprocessors for configuring the computer system as a multiprocessor system. Memory 114 includes an application program 115 which stores, in part, instructions and data for execution by processor 112. If the system of the present invention is wholly or partially implemented in software, including a computer program, memory 114 stores the executable code when in operation. Memory 114 may include banks of dynamic random access memory (DRAM) as well as high-speed cache memory.

Figure 5:
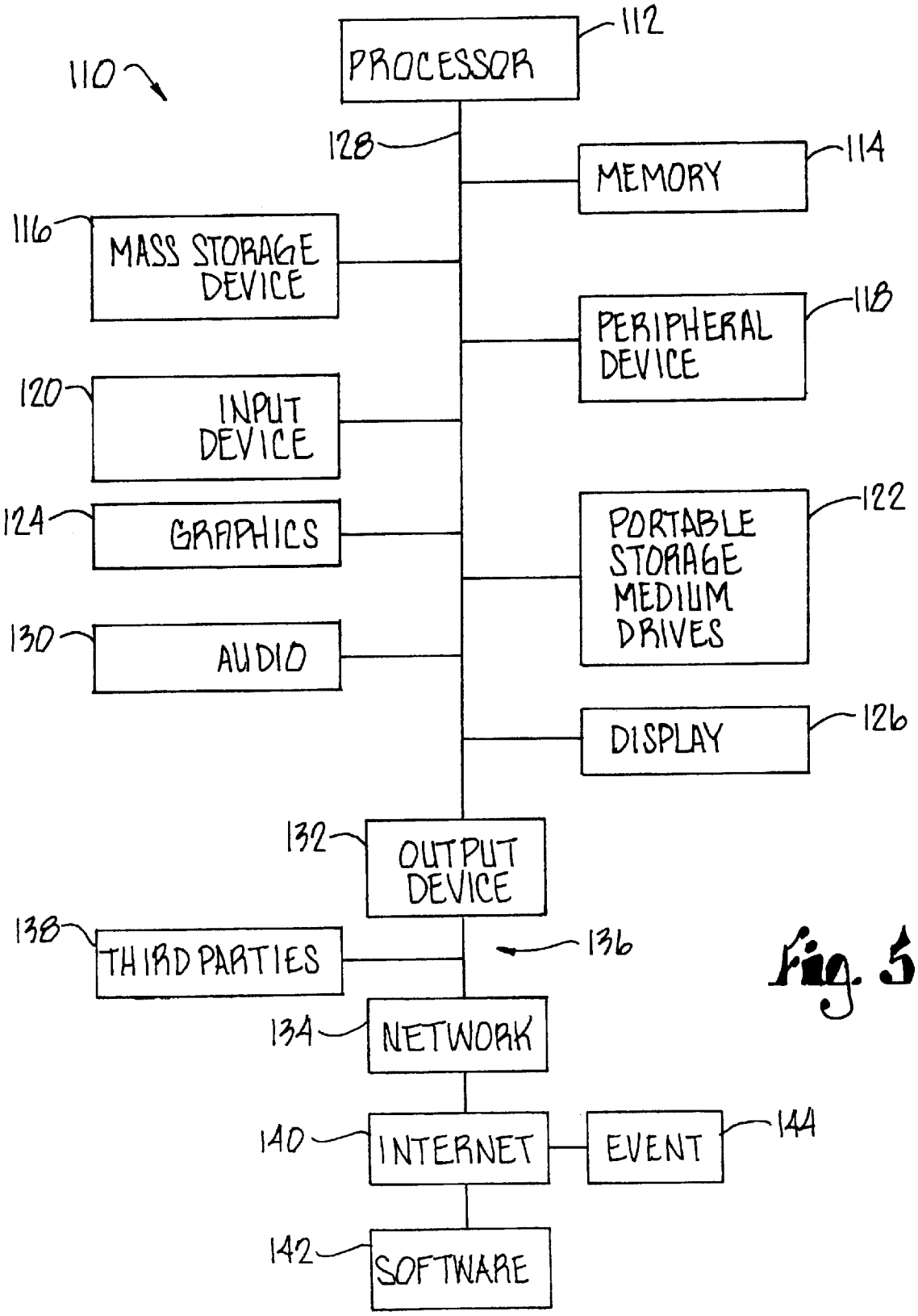
FIG. 5 is a flowchart of the computer system used for the present invention.

The system of FIG. 5 further includes a mass storage device 116, peripheral device(s) 118, input device(s) 120, portable storage medium drive(s) 122, a graphics subsystem 124 and a display 126. For purposes of simplicity, the components shown in FIG. 5 are depicted as being connected via a single bus 128. However, the components may be connected through one or more data transport means. For example, processor 112 and memory 114 may be connected via a local microprocessor bus, and the mass storage device 116, peripheral device(s) 118, portable storage medium drive(s) 122, and graphics subsystem 124 may be connected via one or more input/output (I/O) buses. Mass storage device 116, which is typically implemented with a magnetic disk drive or an optical disk drive, is a non-volatile storage device for storing data and instructions for use by processor 112. In another embodiment, mass storage device 116 stores the computer program implementing the method of the present invention for interfacing with a three-dimensional object for purposes of loading such program to memory 114. The game of the present invention also may be stored in processor 112.

Portable storage medium drive 122 operates in conjunction with a portable non-volatile storage medium, such as a floppy disk, or other computer-readable medium, to input and output data and code to and from the computer system of FIG. 5. In one embodiment, the game of the present invention for interfacing with a three-dimensional object is stored on such a portable medium, and is input to the computer system 110 via the portable storage medium drive 122. Peripheral device(s) 18 may include any type of computer support device, such as an input/output (I/O) interface, to add additional functionality to the computer system 110. For example, peripheral device(s) 118 may include a network interface card for interfacing computer system 110 to a network, a modem, and the like.

Input device(s) 120 provide a portion of a user interface. Input device(s) 120 may include an alpha-numeric keypad for inputting alphanumeric and other key information, or a pointing device, such as a mouse, a trackball, stylus or cursor direction keys. Such devices provide additional means for interfacing with the three-dimensional objects in the method of the present invention. In order to display textual and graphical information, the computer system 110 of FIG. 1 includes graphics subsystem 124 and display 126. Display 126 may include a cathode ray tube (CRT) display, liquid crystal display (LCD), other suitable display devices, or means for displaying, that enables a user to view a three-dimensional object. Graphics subsystem 124 receives textual and graphical information and processes the information for output to display 126. Display 126 can be used to display a three-dimensional object, component interfaces and/or display other information that is part of a user interface. The display 126 provides a practical application of the method of interfacing with a three-dimensional object of the present invention since the method of the present invention may be directly and practically implemented through the use of the display 126. The system 10 of FIG. 5 also includes an audio system 130. In one embodiment, audio system 130 includes a sound card that receives audio signals from a microphone that may be found in peripherals 118. Additionally, the system of FIG. 5 includes output device(s) 132. Examples of suitable output devices include speakers, printers, and the like.

The devices contained in the computer system of FIG. 5 are those typically found in general purpose computer systems, and are intended to represent a broad category of such computer components that are well known in the art. The system of FIG. 5 illustrates one platform which can be used for practically implementing the method of the present invention. Numerous other platforms can also suffice, such as Macintosh-based platforms available from Apple Computer, Inc., platforms with different bus configurations, networked platforms, multi-processor platforms, other personal computers, PDAs (e.g., Palm Pilots®, 3Com), workstations, mainframes, navigation systems, and the like.

Alternative embodiments of the use of the method of the present invention in conjunction with the computer system 110 further include using other display means for the monitor, such as CRT display, LCD display, projection displays, or the like. Likewise, any similar type of memory, other than memory 114, may be used. Other interface means, in addition to the component interfaces, may also be used including alphanumeric keypads, other key information or any pointing devices such as a mouse, trackball, stylus, cursor or direction key.

In a further embodiment, the present invention also includes a computer program product which is a storage medium (media) having instructions stored thereon/in which can be used to program a computer to perform the method of interfacing of the present invention. The storage medium can include, but is not limited to, any type of disk including floppy disks, optical disks, DVD, CD ROMs, magnetic optical disks, RAMs, EPROM, EEPROM, magnetic or optical cards, or any type of media suitable for storing electronic instructions.

Stored on any one of the computer readable medium (media), the present invention includes software for controlling both the hardware of the general purpose/specialized computer or microprocessor, and for enabling the computer or microprocessor to interact with a human user or other mechanism utilizing the results of the present invention. Such software may include, but is not limited to, device drivers, operating systems and user applications. Ultimately, such computer readable media further includes software for performing the game of interfacing of the present invention.

As illustrated in FIG. 5, computer system 110 is coupled to network 134, such as the Internet 140, across communications lines 136. Preferably, the communications lines 136 are dedicated lines (e.g., LAN, WAN, standard dialout phone line, dedicated lease line, DSL) with a frame relay (or point-to-point) connection. Computer system 110 may be directly linked to third party vendees (e.g., other game sites) with the software of the present invention rather than communicating with computer system 110 through the Internet. The third party computer systems 138 are, for example, a mainframe or PCs of at least XX486 processing ability (e.g., Pentium CPU) having one gigabyte drive, 16 megabytes of RAM (random access memory), with typical I/O accessories including a keyboard, display, mouse and printer, or similar workstation. Each of the third party computer systems 138 and system 110 (specifically the output device or server 132) also have a modem (e.g., CSDSU, T1 communication, DSL or cable modems) for coupling to the communication line 136 and enabling communications between system 110 and third party computer system 138.

Mass storage device or server 116, output device or server 132 and memory 114 may be implemented by one digital processor 112. In that case, consolidation, scheduling, initial and subsequent segmenting of customers and execution of working programs are accomplished through the one processor running the inventive software. Neural networks may be employed to operate on mass storage device 116 and portable storage medium drives 122 to learn each individual player's purchasing game behavior and characteristics and segment players accordingly. In using the present invention, the customer may be assisted by a third party. The customer need not be the person who actually enters information into the system.

Further, instead of the neural networks, a multiple regression correlation based on player data in devices 116 and 122 may be used for segmenting players and customers. Alternatively, rule based expert systems may be similarly employed in the present invention to provide dynamic player behavioral and purchasing segmentation.

In a further example as more fully described below, the invention may be employed on the Internet 140. In this event, the processor 112 is operative to transfer the application program 115 out of the memory 114 and display an Internet graphical user interface (GUI) on the display 126 and execute graphical Internet protocol programs, to connect said Internet 140 and transfer data between said electronic chess game and said graphical user interface. A website can be created with a home page with topic selections and links (e.g., Hypertext HTML technology) to the application program 115 triggering questionnaires, initiations of games and information. In particular, for each topic selection there is a respective hyperlink to the application program 115 and optionally an event 144 for initiating program 115. Upon the player's selection of a topic from the home page, the present invention applies the linked event 144, if any. If the criteria of the event 144 are met (or if there is no initiating event 144), then the present invention executes the corresponding application program 115. This results in the application program 115 contents being transmitted online to the user.

In another embodiment, the present inventive system 10 is based on a non-networked computerized device, such as a PDA. (e.g., Palm Pilot®—3Com, Inc.)

The foregoing description of the embodiments of the invention has been presented for purposes of illustration and description, and is not intended to be exhaustive or to limit the invention to the precise form disclosed. The description was selected to best explain the principles of the invention and practical application of these principles to enable others skilled in the art to best utilize the invention in various embodiments and modifications as are suited to the particular use contemplated. It is intended that the scope of the invention not be limited by the specification, but be defined by the claims set forth below.

What is claimed is:

1. A chess game for two opposed players, comprising:

(a) a six-by-eight checkerboard-style game board having first and second ends, a pair of opposed sides, and a playing surface comprising a plurality of alternating dark and light squares to form a checkerboard pattern; said squares forming a plurality of rows extending between said sides, and a plurality of columns extending between said ends;

(b) two sets of game pieces, including a set of light colored pieces for one of said opposed players, and a set of dark colored pieces for the other of said opposed players; each said set of game pieces consisting of one King, one Queen, one Lord, one Rook, one Bishop, one Knight, and six Pawns;

(c) said Lord, said King, said Queen, said Bishop, said Knight, and said Rook of said set of light-colored game pieces having initial locations in respective squares in the row of squares immediately adjacent the first end of said gameboard; said Lord, said King, said Queen, said Bishop, said Knight, and said Rook of said set of dark-colored game pieces having initial locations in respective squares in the row of squares immediately adjacent the second end of said gameboard in mirrored relation to the initial locations of said light-colored game pieces; and (d) said light-colored Pawns having initial locations in the respective squares in the penultimate row adjacent said first end; said dark-colored Pawns having initial locations in the respective squares in the penultimate row adjacent said second end.

2. The chess game of claim 1, wherein the game board includes eight rows.

3. The chess game of claim 1, wherein the game board includes six columns.

4. The chess game of claim 1, wherein the game board includes forty-eight squares.

5. The chess game of claim 1, wherein the Lord is initially positioned immediately adjacent the King.

6. A method of playing a game of chess by opposed players; said game consisting of two sets of distinguishable playing pieces, one for each player, each set having a King, a Queen, a Lord, a Rook, a Knight, a Bishop and six Pawns, a game board consisting of a first end, a second end, and a plurality of alternatingly colored rows and columns, said rows and columns intersecting to form a plurality of alternatingly colored squares, the method comprising the steps of:

(a) placing each player's set of playing pieces on the game board so that one set of playing pieces occupies a first row of squares adjacent and parallel to the first end of the game board and a second row of squares adjacent and parallel to said first row of squares; and the other set of playing pieces occupies a third row of squares adjacent to the second end of the game board and a fourth row of squares adjacent and parallel to said third row of squares;

(b) said players taking turns consisting of one or more alternating moves of the pieces; said alternating moves continuing until one player places the opposing player's King in checkmate, or the expiration of a predetermined period of time;

(c) the moves of said King, said Queen, said Bishop, said Rook, said Knight and said Pawn being conducted according to the rules of conventional chess;

(d) the moves of said Lord consisting of a movement one square in any horizontal, vertical, or diagonal direction to any available adjacent square.

7. The method of claim 6, wherein each of said moves must be taken within fifteen seconds.

8. The method of claim 6, and further comprising the step of one castling move per game by each said player.

9. The method of claim 6, and further comprising the step of promoting said pawns upon reaching rank.

10. The method of claim 6, further comprising the step of means for assigning points values to the playing pieces for determining a winner at the expiration of the predetermined period of time.

11. The method of claim 10, wherein a winner is declared as the player with the highest said point value at the expiration of the predetermined period of time.

12. The method of claim 6, further comprising the step of means for assigning point values to the playing pieces for determining a winner upon termination of the game by checkmate.

13. The method of claim 12, wherein the winner is declared as the player with the highest said point value upon the checkmate.

14. A chess game played by opposing players of a game board, comprising a pair of game piece sets; each said game piece set including a King and a Lord; said game board having first and second ends, a pair of opposed sides, and a plurality of alternating dark and light squares which form a checkerboard pattern; said game piece sets positioned on said squares of said game board in spaced-apart mirrored relation; each said player controlling a respective said set of game pieces on said game board during said game; said Lord capable of moving about the game board during said game from its current square to any available adjacent square said chess game not ending when said Lord game piece is captured; and said chess game ending when said King is captured.

15. The chess game of claim 14, wherein each said game piece set further comprises a Queen, a Rook, a Bishop, a Knight, and a plurality of pawns.

16. The chess game of claim 14, wherein the squares of said game board form eight horizontal rows.

17. The chess game of claim 14, wherein the squares of said game board form six vertical columns.

18. The chess game of claim 14, wherein the game board includes forty-eight said squares.

19. The chess game of claim 14, wherein each said Lord is initially positioned immediately adjacent one of said Kings.

20. An electronic chess game, said game including two sets of distinguishable playing pieces, one for each player, each set having a King, a Queen, a Lord, a Rook, a Knight, a Bishop and six Pawns, a game board consisting of a first end, a second end, and a plurality of alternatingly colored rows and columns, said rows and columns intersecting to form a plurality of alternatingly colored squares, comprising:

(a) a display device for displaying visual images of said playing pieces and said game board to a human observer;

(b) an input device for inputting input data; means for processing said data to allow a player to move said playing pieces about said game board on said display;

(c) a memory device for storing data; said memory device having an application program stored therein; said memory device being operative to transfer said application program out of said system memory and display a graphical user interface (GUI) on said display device; and (d) a bus for transporting input and output signals between the input device, the display, and the memory device.

21. The electronic chess game of claim 20, further comprising means for connecting a plurality of said electronic chess games to one another for play between said opposing players through a global network of computers; each said processor of said global network of computers is operative to transfer said application program out of said memory device and display an Internet graphical user interface (GUI) on said video display device and execute graphical Internet protocol programs, to connect said electronic chess game to said global network of computers and transfer data between said chess game and said graphical user interface.

* * * * *